US005163395A

United States Patent [19]

Ishii

[11] Patent Number: 5,163,395

[45] Date of Patent: Nov. 17, 1992

[54] TWO STROKE DIESEL ENGINE

[75] Inventor: Mitsunori Ishii, Kanagawa, Japan

[73] Assignee: Nissan Motor Co., Ltd., Japan

[21] Appl. No.: 741,267

[22] Filed: Aug. 7, 1991

[30] Foreign Application Priority Data

Aug. 8, 1990 [JP] Japan ..... 2-209521

[51] Int. Cl.[5] ..... F02B 3/00

[52] U.S. Cl. ..... 123/257; 123/65 VD; 123/263; 123/193.5

[58] Field of Search ..... 123/193 H, 193 CH, 657, 123/658, 668, 262, 263, 257, 270, 301, 65 VD, 432, 285, 655, 261, 302, 305

[56] References Cited

U.S. PATENT DOCUMENTS

| | | | |
|---|---|---|---|
| 4,052,972 | 10/1977 | Mizunuma et al. | 123/193 H |
| 4,258,680 | 3/1981 | Eckert | 123/263 |
| 4,291,655 | 9/1981 | Yamakawa | 123/193 H |
| 4,378,764 | 4/1983 | Jorgensen | 123/193 A |
| 4,854,280 | 8/1989 | Melchior | 123/65 VD |
| 4,998,517 | 3/1991 | Kawamura | 123/270 |
| 5,014,663 | 5/1991 | Melchior | 123/257 |

FOREIGN PATENT DOCUMENTS

| | | |
|---|---|---|
| 62-57733 | 4/1987 | Japan . |
| 1-315631 | 12/1989 | Japan . |

*Primary Examiner*—E. Rollins Cross
*Assistant Examiner*—M. Macy
*Attorney, Agent, or Firm*—Lowe, Price, LeBlanc & Becker

[57] ABSTRACT

In a two stroke diesel engine which comprises a combustion chamber formed by a cylinder, piston head and base of the cylinder head, a cavity formed on the base of the cylinder head facing the combustion chamber, intake valves fitted to the cylinder head facing the cavity, a fuel injection valve fitted to the cylinder head facing the cavity, and exhaust valves fitted to the base of the cylinder head, fresh gas entering from the intake valves flows into the combustion chamber via the cavity in a scavenging step, and effectively sweeps out burnt gas. Further, as fuel and air are mixed in the cavity near the top dead center of the piston stroke, and this gas mixture is ejected together with the flame that ignited in the cavity into the combustion chamber as the piston descends, combustion in the chamber takes place efficiently.

5 Claims, 8 Drawing Sheets

TWO STROKE DIESEL ENGINE

FIELD OF THE INVENTION

This invention relates to a two stroke diesel engine, and more particularly the shape of the combustion chamber, the arrangement of fuel injection valves, and the arrangement of intake and exhaust valves in such an engine.

BACKGROUND OF THE INVENTION

Injection systems for direct fuel injection in two stroke diesel engines are for example disclosed in Jikkaisho No. 62-57733 and Tokkaihei No. 1-315631 published by the Japanese Patent Office.

In the case of direct injection in these engines, fuel was injected into the combustion chamber in the latter half of the compression stroke. Due to the short period between the fuel injection and ignition, however, the injected fuel was apt to be insufficiently converted to fine particles, not well dispersed throughout the combustion chamber and poorly mixed with air. This led to poor fuel consumption performance and reduced power, and an undesirable composition of exhaust gases.

In a two stroke diesel engine, exhaust and intake valves are opened in the same down stroke of the piston and the scavenging efficiency of burnt gas is naturally lower than a four stroke engine. This also deteriorates the performance and exhaust gas composition of a two stroke diesel engine.

SUMMARY OF THE INVENTION

It is therefore an object of this invention to enhance the gas scavenging effect whereby fresh gases led into the combustion chamber of a two stroke diesel engine assist the expulsion of burnt gases.

It is another object of this invention to improve the combustion environment by promoting better mixing of fuel and air in a two stroke diesel engine.

To achieve these objects, this invention provides a two stroke diesel engine comprising a combustion chamber formed by a cylinder, piston head and base of the cylinder head, a cavity formed on the base of the cylinder head adjacent to the combustion chamber, intake valves fitted to the cylinder head adjacent to the cavity, a fuel injection valve fitted to the cylinder head adjacent to the cavity, and exhaust valves fitted to the base of the cylinder head.

DESCRIPTION OF THE PREFERRED EMBODIMENTS

Figure 1:
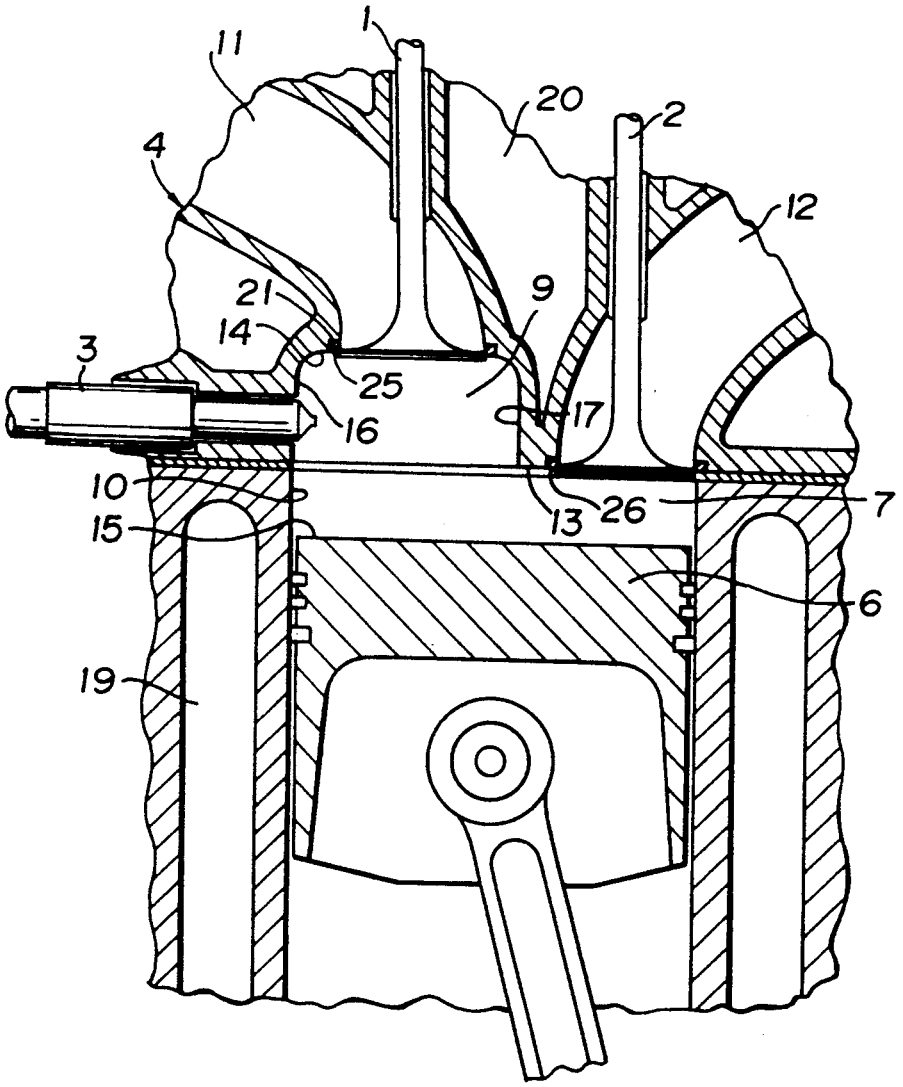
FIG. 1 shows a vertical section of the cylinder head and upper part of the cylinder in a two stroke diesel engine illustrating a preferred embodiment of this invention.

The diesel engine shown in FIG. 1 is provided with a combustion chamber 7 formed by a flat surface 13 in the base of a cylinder head 4, a cylinder 10, and a piston head 15 of a piston 6.

The piston head 15 and flat surface 13 are formed parallel to one another, and they approach each other at the top dead center of piston 6 so that the gap between them is efficiently zero. Water jackets 19 and 20 are provided on the outer surface of the cylinder 10.

Figure 2:
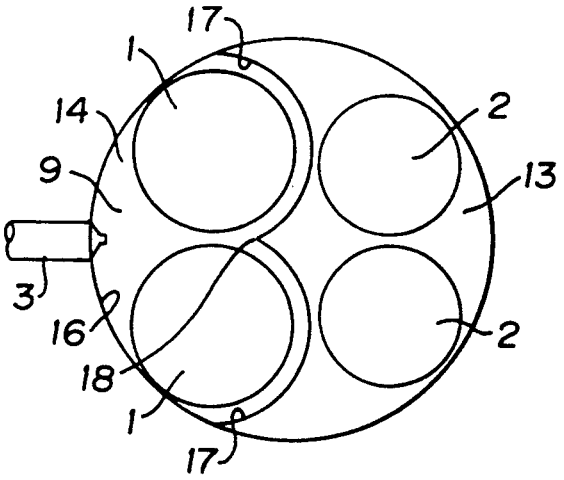
FIG. 2 is a plan view of the cylinder head in FIG. 1 viewed from the combustion chamber.

A pair of exhaust ports 12 opens downwards onto the surface 13. A dome-like cavity 9 is formed on the surface 13 as shown in FIG. 2, and a pair of intake ports 11 also opens downwards onto the roof of the cavity.

An intake valve 1 is fitted to each intake port 11, and an exhaust valve 2 is fitted to each exhaust port 12. These valves 1 and 2 are arranged such that their center axes are parallel to the center axis of the cylinder 10. The intake valves 1 are seated in a seat 25 which forms part of the flat roof of the cavity 9. The exhaust valves 2 are seated in a seat 26 which forms part of the flat surface 13.

A fuel injection valve 3 is provided on the inner surface of the cavity 9. This valve 3 projects substantially horizontally from an extension wall 16 of cavity 9 which is continuous with the side walls of the chamber 7.

Figure 3:
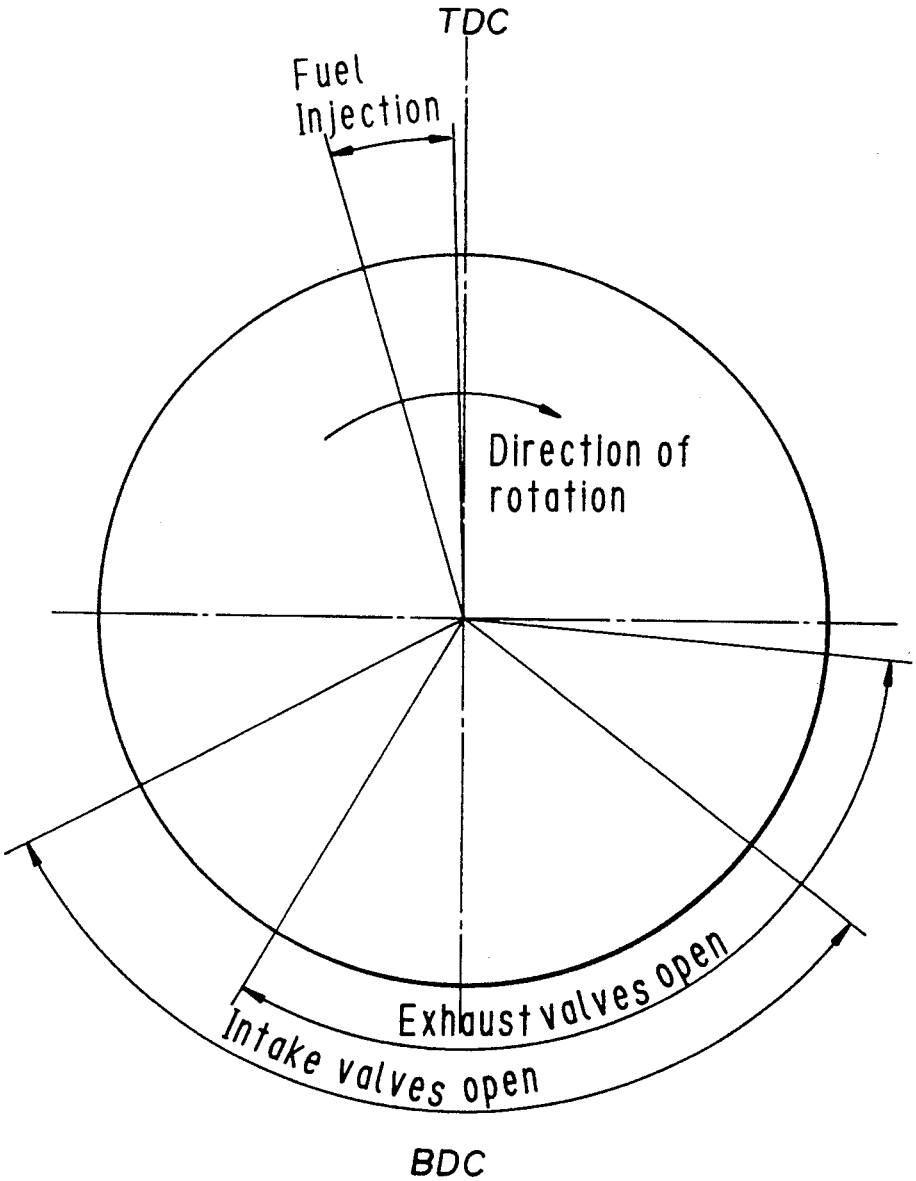
FIG. 3 is a graph describing the times of valve opening and closing and the timing of fuel injection.

Further, cylindrical walls 17 are formed between the cavity 9 and the surface 13. These walls 17 lie at a fixed distance from the rim of each intake valve 1. The fuel injection valve 3 is supported opposite an edge 18 which joins these walls 17, and injects fuel towards the edge 18 depending on the aperture of the throttle valve and the engine speed. The fuel injection time is set slightly in advance of the top dead center (TDC) of the piston 6 as shown in FIG. 3.

The intake ports 11 are connected to a supercharger. The intake valves 1 open during the latter half of the descent of the piston 6, and shut during the first half of the rise of piston 6 after it has passed bottom dead center (BDC) as shown in FIG. 3.

The exhaust valves 2 open before the intake valves 1, and shut before the valves 1.

The valves 1 and 2 are made to open and close in synchronization with the movement of piston 6 by means of cams fitted to the cylinder head 4.

When the piston 6 descends, the exhaust valves 2 open, burnt gas is expelled from the ports 12, after then the intake valves 1 open, and fresh gas flows into the cavity 9 and the chamber 7 from the ports 11.

Figure 4C:
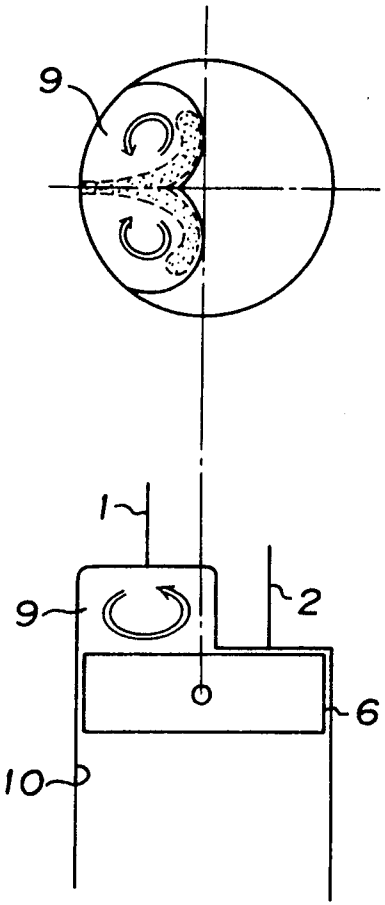
FIGS. 4*a*, 4*b* and 4*c* are descriptive drawings showing the flow of gases in the combustion chamber.
Figure 4B:
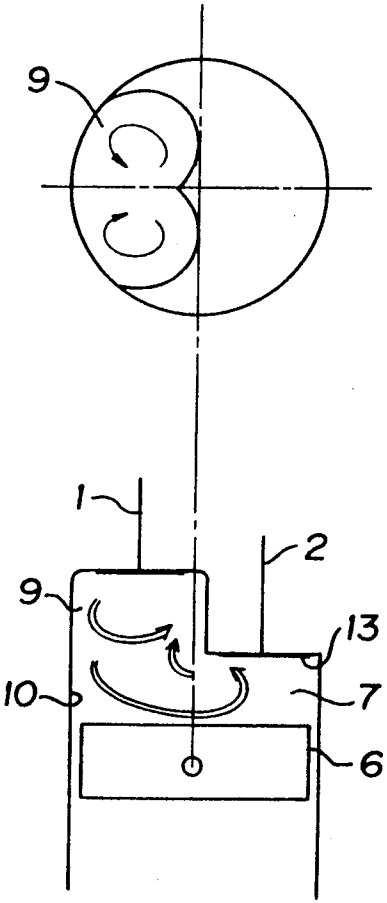
Figure 4A:
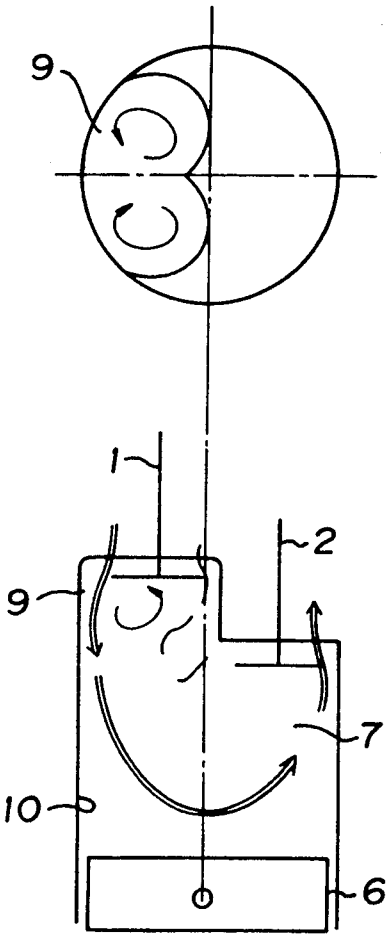

FIG. 4*a* shows the gas flow in the region of bottom dead center of the piston 6. As the gap between the rim of each intake valve 1 and the walls 17 of the cavity 9 is small, fresh gas flows mainly into the chamber 7 along the extension wall 16 which is continuous with the wall of chamber 7. It then collides with the piston head 15, veers to the sides, and veers again towards the exhaust ports 12.

Due to this loop-shaped flow of fresh gas, burnt gas in the chamber 7 is pushed towards the ports 12 and replacement of burnt gas by fresh gas is promoted. Further, as the fresh gas has a long flow path, its expulsion from the ports 12 is limited.

FIG. 4*b* shows the gas flow in the compression stroke. When the piston 6 approaches top dead center the gap between the piston head 15 and the surface 13 is effectively zero, air is blown strongly into the cavity 9, and symmetrical swirl flows are set up by the fresh gas led in by the walls 17 beneath the intake valves 1.

Fuel is then injected by the fuel injection valve 3 into the compressed air which has been pushed into the cavity 9 by piston 6, as shown in FIG. 4*c*. The flow of fuel mist produced by the injection and air is divided by the edge 18 which projects in a V-shape into the cavity 9, and swirls along both walls 17. This promotes better mixing of fuel and air, and allows compression ignition to take place when the fuel is in a suitable state of dispersion.

As the piston 6 descends, the flame and unburnt fuel in the cavity 9 spread out into the chamber 7 of the cylinder 10, and combustion continues in the chamber 7.

Further, even if liquid fuel adheres to the wall of the cavity 9 due to the fuel injection, it is mainly distributed on the walls 17 near edge 18, and is stripped off by the jet flow from cavity 9 to chamber 7. Fuel thereby mixes properly with the air, and air is used efficiently in the combustion.

As there is no cavity in the piston head 15, moreover, the thermal load on piston 6 due to the combustion is small, and higher engine power can be obtained.

Figure 5:
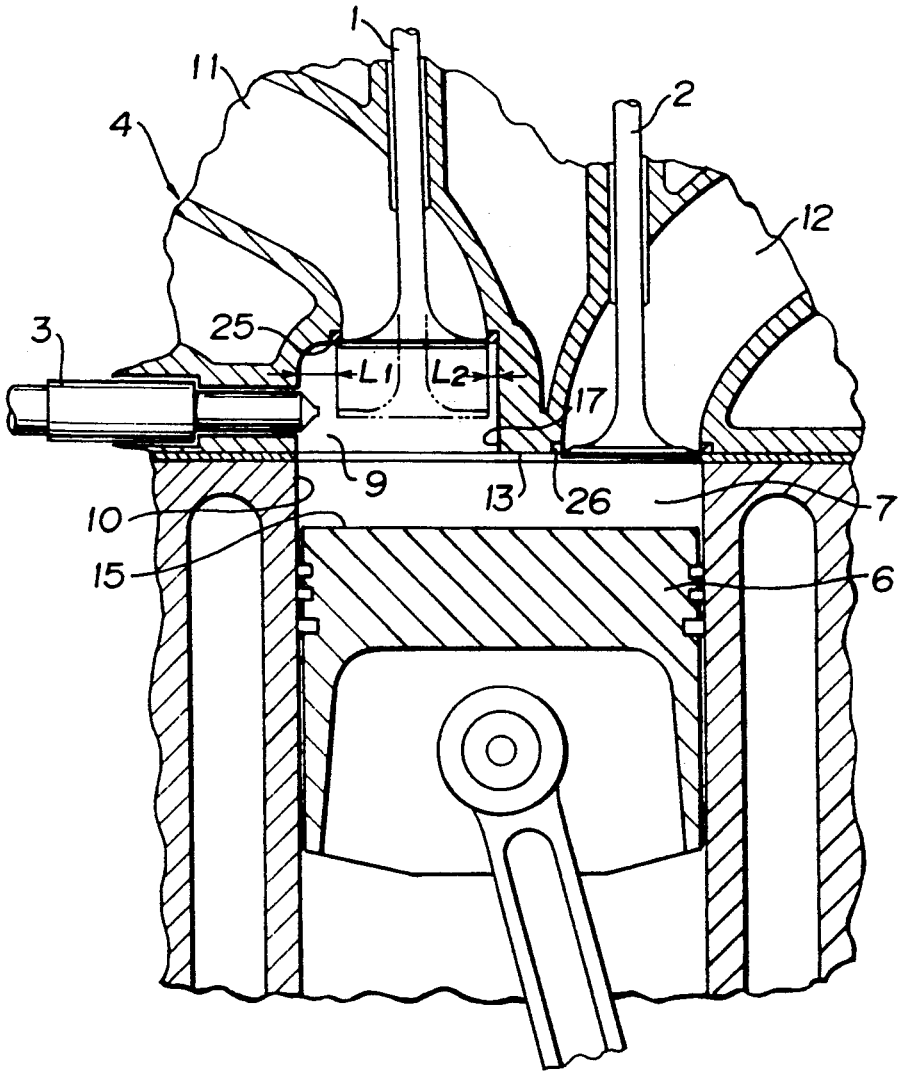
FIG. 5 shows a vertical section of the cylinder head and upper part of the cylinder in a two stroke diesel engine illustrating another preferred embodiment concerning the position of the intake valves.
Figure 6:
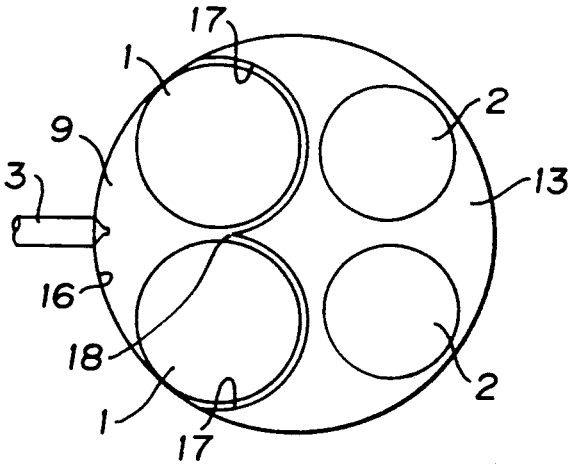
FIG. 6 is a plan view of the cylinder head in FIG. 5 viewed from the combustion chamber.

As shown in FIGS. 5 and 6, the gap $L_2$ between the walls 17 and the intake valves 1 may be set smaller than the gap $L_1$ between the cylinder extension wall 16 and the intake valves 1. This increases the force of fresh gas flowing from the ports 11 to the extension wall 16 of the cavity 9 in the scavenging stroke, enhances the scavenging effect and increases air utilization efficiency in the combustion.

Figure 7:
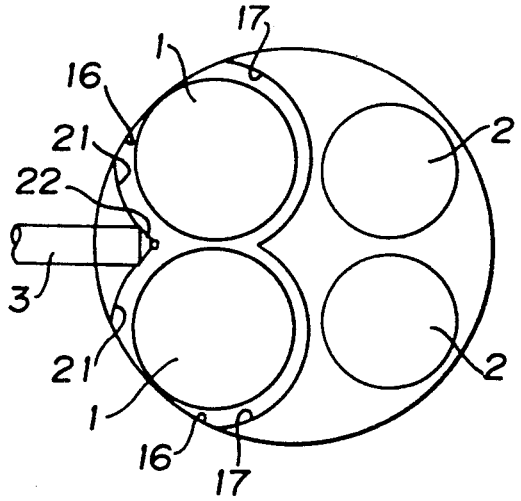
FIG. 7 is a plan view of the cylinder head viewed from the combustion chamber illustrating another preferred embodiment concerning the shape of the cavity.

Further, as shown in FIG. 7, cylindrical walls 21 may also be formed on the extension wall 16 at effectively equal distances from the rims of the intake valves 1. This helps the fresh gas flowing into the cavity 9 from the ports 1 to set up swirls along the walls 17 and 21, further enhancing the scavenging effect and increasing air utilization efficiency in the combustion. In this case, the fuel injection valve 3 is arranged facing the cavity 9 at an edge 22 joining the walls 21.

Figure 9:
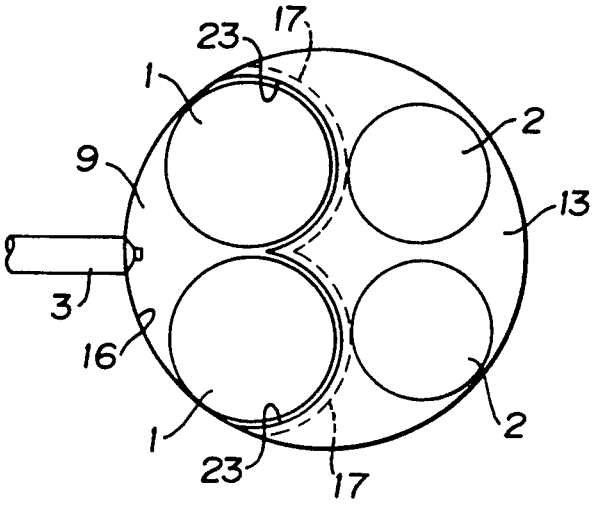
FIG. 9 is a plan view of the cylinder head in FIG. 8 viewed from the combustion chamber.
Figure 8:
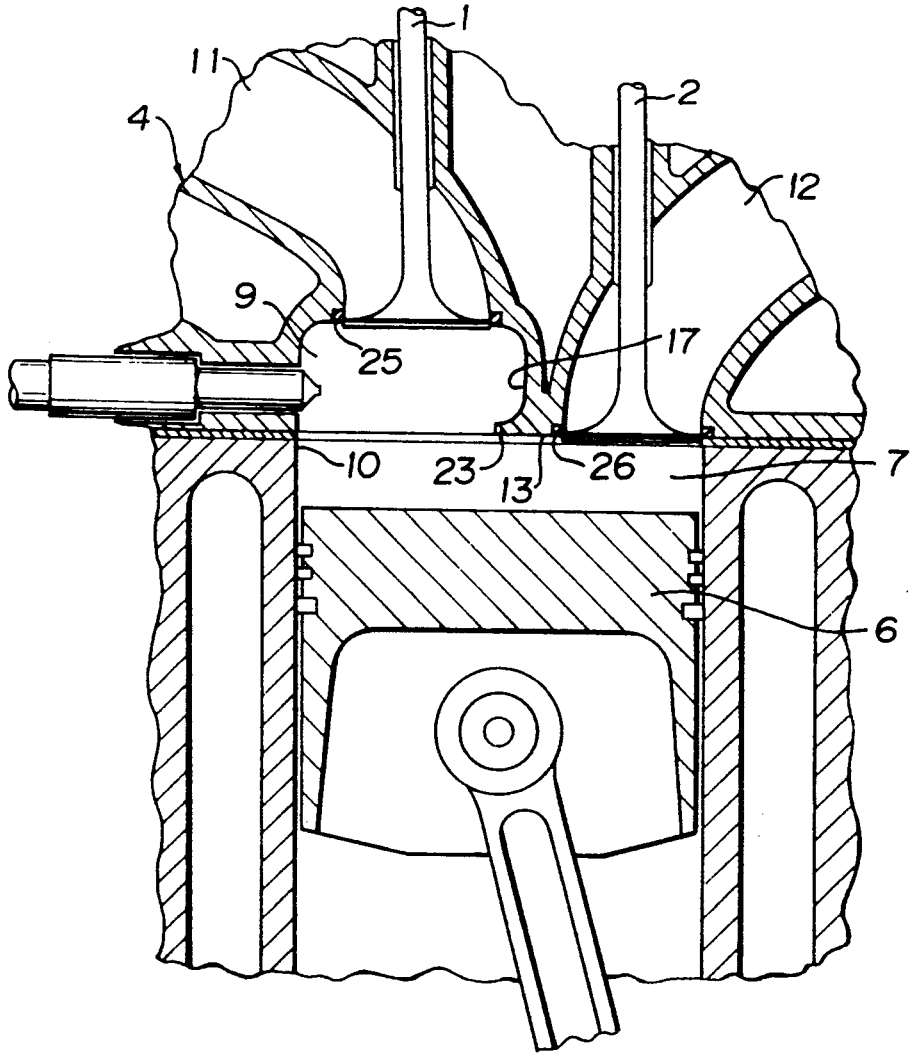
FIG. 8 shows a vertical section of the cylinder head and upper part of the cylinder in a two stroke diesel engine illustrating another preferred embodiment concerning the shape of the cavity.

Further, as shown in FIGS. 8 and 9, arc-shaped guides 23 may be formed such that they project into the cavity 9 on the lower edge of the walls 17. This increases the air flow along the extension wall 16 into the chamber 7 which further enhances the scavenging effect, and by increasing the force with which the flame and unburnt fuel spreading out from the cavity 9 is flowing along the extension wall 16 into chamber 7, air utilization efficiency in the combustion is further increased.

Figure 10:
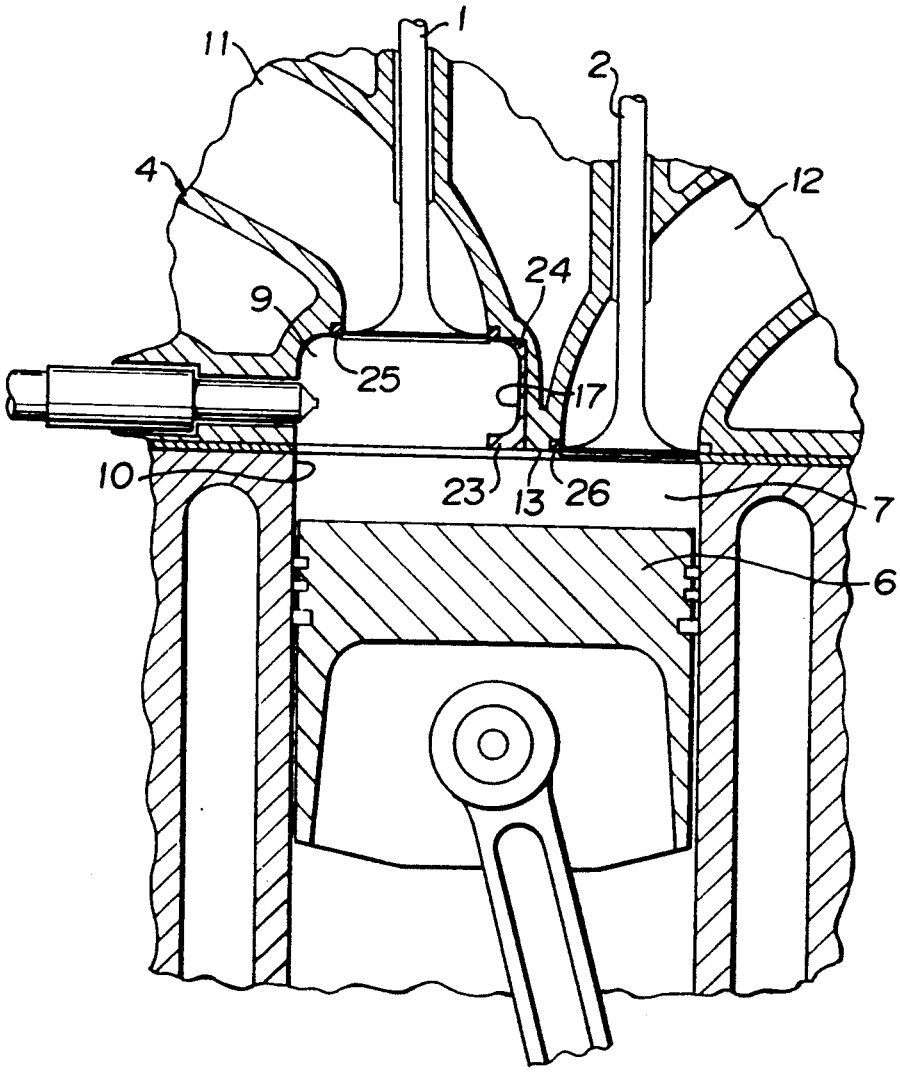
FIG. 10 shows a vertical section of the cylinder head and upper part of the cylinder in a two stroke diesel engine illustrating another preferred embodiment concerning the structural materials of the cavity.

Further, if the guides 23 are formed as part of a ceramic element 24 as is shown in FIG. 10, the heat resistance of guides 23 which are subject to a high thermal load can be increased, and engine endurance can be improved.

The foregoing description of a preferred embodiment for the purpose of illustrating this invention is not to be considered as limiting or restricting the invention, since many modifications may be made by the exercise of skill in the art without departing from the scope of the invention.

The embodiments of the invention in which an exclusive property or privilege is claimed are defined as follows:

1. A two stroke diesel engine comprising:

a cylinder with a cylinder wall and an open end;

a cylinder head having a flat base which closes the open end of said cylinder;

a piston accommodated in said cylinder such that it is free to slide in said cylinder between its top dead center and bottom dead center, said piston having a flat piston head disposed parallel to the base of said cylinder head;

a combustion chamber formed in said cylinder by said piston head and the base of said cylinder head, said combustion chamber having a minimum capacity when said piston is at the top dead center, a cavity formed in said cylinder head with an opening in the base of said cylinder head, said cavity having a roof with a flat surface parallel to the base of said cylinder head, an extension wall continuous with said cylinder wall and a first pair of cylindrical walls facing said extension wall, said first pair of cylindrical walls defining a common edge wherein said walls intersect and a lower edge disposed at the opening of said cavity;

a pair of intake valves and seats therefor provided in said cylinder head facing said cavity, said intake valve seats forming a part of the flat surface of said cavity roof, each of said intake valves having a rim disposed equidistantly from one of said cylindrical walls, a fuel injection valve mounted in said extension wall and disposed substantially horizontally in front of and perpendicular to the common edge of said first pair of cylindrical walls, and exhaust valves provided in the base of said cylinder head.

2. A two stroke diesel engine as defined in claim 1, wherein the distance between the rims of said intake valves and said cylindrical walls is less than the distance between the rims of said intake valves and said extension wall.

3. A two stroke diesel engine as defined in claim 1, wherein said cavity has a second pair of cylindrical walls having a common edge where said walls intersect, said second pair of cylindrical walls being arranged in facing relation to said first pair of cylindrical walls so that the common edge of said second pair of cylindrical walls projects from said extension wall and said fuel injection valve is mounted in this edge portion of said extension wall.

4. A two stroke diesel engine as defined in claim 1, wherein guides having an arc-shaped guide surface are provided on the lower edge of said first pair of cylindrical walls to guide the gas flowing in from the intake valves towards the center of said cavity.

5. A two stroke diesel engine as defined in claim 4, wherein said first pair of cylindrical walls including said guides are constructed of ceramic materials.

* * * * *